United States Patent [19]

Lee

[11] Patent Number: 4,918,847

[45] Date of Patent: Apr. 24, 1990

[54] COMBINED DISPLAY BOARD AND CLIP

[75] Inventor: Yeou-Ching Lee, Taipei, Taiwan

[73] Assignee: Alvin Lee Jewelry, Inc., Taipei, Taiwan

[21] Appl. No.: 265,996

[22] Filed: Nov. 2, 1988

[51] Int. Cl.[5] ..... G09F 1/12

[52] U.S. Cl. ..... 40/152.1; 40/1.6; 40/652

[58] Field of Search ..... 40/1.6, 152.1, 652, 40/661, 653, 649, 1.5, 642; 24/3 J, 507, 510, 10 R

[56] References Cited

U.S. PATENT DOCUMENTS

| | | | |
|---|---|---|---|
| 399,017 | 3/1889 | Campbell | 40/152.1 |
| 824,516 | 6/1906 | Suessland | 40/652 |
| 955,257 | 4/1910 | Fridell | 24/510 X |
| 1,896,695 | 2/1933 | Borovicka | 40/653 X |
| 2,360,815 | 10/1944 | Mungen | 40/1.5 |
| 3,918,187 | 11/1975 | Vogele | 40/152.1 X |
| 4,098,014 | 7/1978 | Lauer et al. | 40/1.5 |
| 4,502,188 | 3/1985 | Kohli | 40/152.1 X |
| 4,597,206 | 7/1986 | Benson | 40/1.6 X |

*Primary Examiner*—James R. Brittain

*Attorney, Agent, or Firm*—Oblon, Spivak, McClelland, Maier & Neustadt

[57] ABSTRACT

A combined display board and clip which comprises a first clamping member, a second clamping member, a mechanism for connecting the first and second clamping members in a pivotal position, a spring for urging the first clamping member to a clamping position with respect to the second clamping member, wherein at least one of the first and second clamping members includes a base plate having opposite edges, a cover plate having opposite edges, and an edge-piece having a groove for releaseably receiving and clamping together the edges of the cover plate and the base plate.

18 Claims, 9 Drawing Sheets

COMBINED DISPLAY BOARD AND CLIP

BACKGROUND OF THE INVENTION

This invention relates to a combined display board and clip which has two clamping members which are interconnected by a pivot means and biased to a clamping position by a torsion spring wherein at least one of the clamping members is a display board including a base plate and a cover plate which are clamped releaseably together by edge pieces so that the cover plate is removable for changing display articles or pictures.

An object of the invention is to provide a combined display board and clip which can be used as a picture frame as well as a clip.

SUMMARY OF THE INVENTION

According to the present invention, a combined display board and clip comprises a first clamping member, a second clamping member, means for connecting the first and second clamping members in a pivotal position, and spring means for urging the first clamping member to a clamping position with respect to the second clamping member, wherein at least one of the clamping members includes a base plate having opposite edges, a cover plate having opposite edges, and an edge-piece means having a groove means for releaseably receiving and clamping together the edges of the cover plate and the base plate.

The present exemplary preferred embodiments will be described in detail with reference to the accompanying drawings, in which:

DETAILED DESCRIPTION OF THE PREFERRED EMBODIMENTS

Figure 1:
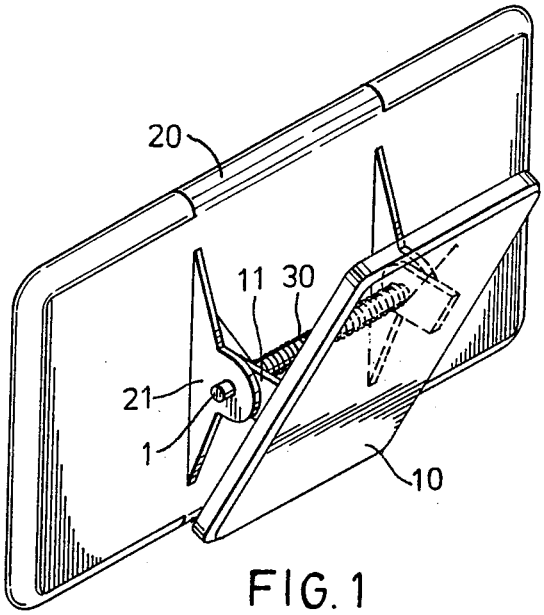
FIGS. 1, 2, and 3 show a first embodiment of the combined display board and clip according to the present invention.
Figure 2:
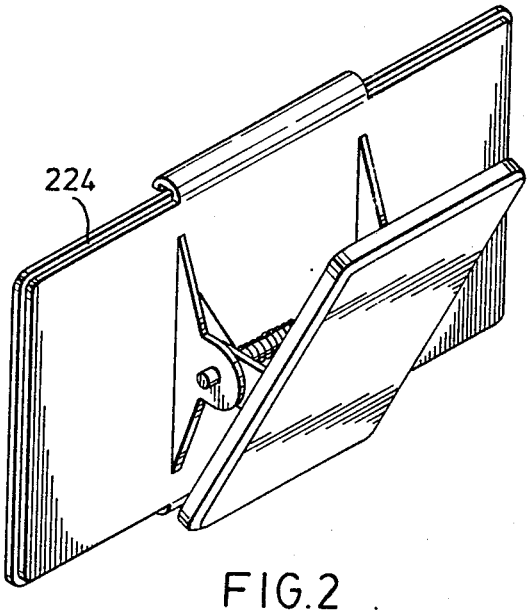
Figure 3:
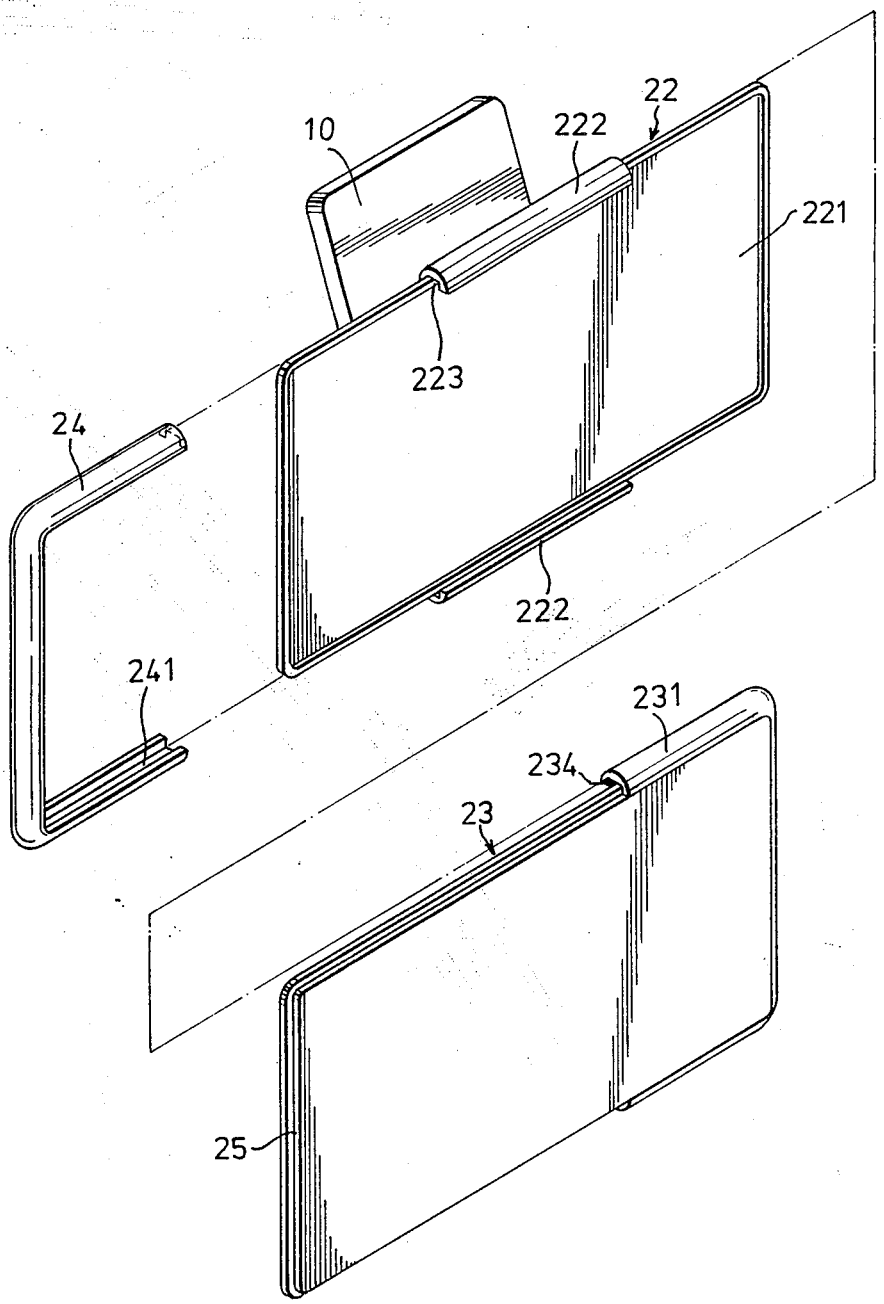

Referring to FIGS. 1, 2 and 3, a first embodiment of a combined display board and clip includes a clip plate 10, a display board 20 which is connected pivotally to the plate, and a torsion spring 30 to urge the clip member 10 to a clamping position relative to the display board. The clip plate 10 and the base plate 20 are provided respectively with bracket plates 11 and 21 which overlap each other and a pin 1 is inserted through the bracket plates 11 and 21. Such a pivot connection is known in the art, therefore the detail thereof is not described hereinafter.

The feature of the present invention resides in the construction of the display board 20 which includes a rectangular base plate 22 and a rectangular cover plate 23. The base plate 22 is provided with a recess 221 for receiving a picture or the like. The cover plate 23 may be a transparent cover for covering the picture placed in the recess 221 or a nontransparent cover which bears a picture thereon. Two edge pieces 222 each with a slide groove 223 are formed integrally and respectively with the upper and lower parallel edges of the base plate 22. A U-shaped edge piece 231 is formed integrally with the cover plate 23 and has a clamping groove 234 for receiving portions of the parallel sides of the base plate and one of the sides interconnecting the parallel sides. A U-shaped edge piece 24 which is a separate piece from the base plate 22 and the cover plate 23 is attached to the base plate and the cover plate on one side of the edge pieces 222 opposite the edge piece 231. The edge piece 24 is provided with a groove 241 for clamping adjacent edges of the base plate and the cover plate. Both the base plate 22 and the cover plate 23 are provided with stepped edges so that a flange 224 is formed on the edge of the base plate 22 and another flange 25 is formed on the edge of the base plate 23. These flanges 224 and 25 are employed for slideable engagement with the grooves of the edges.

Figure 4:
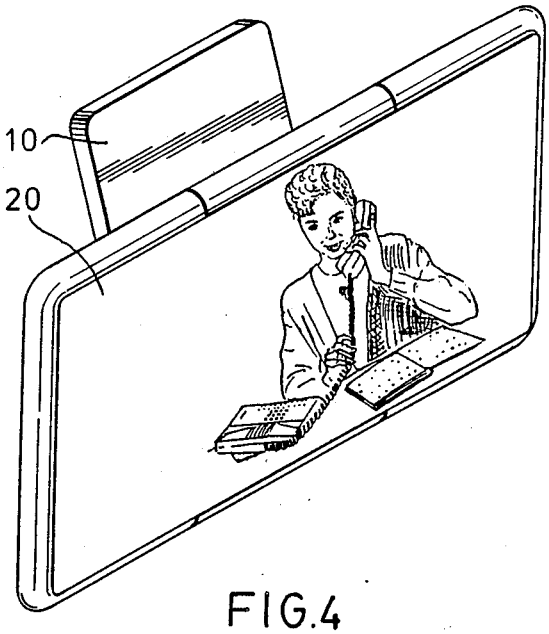
FIGS. 4 and 5 show two displaying positions of the first embodiment.
Figure 5:
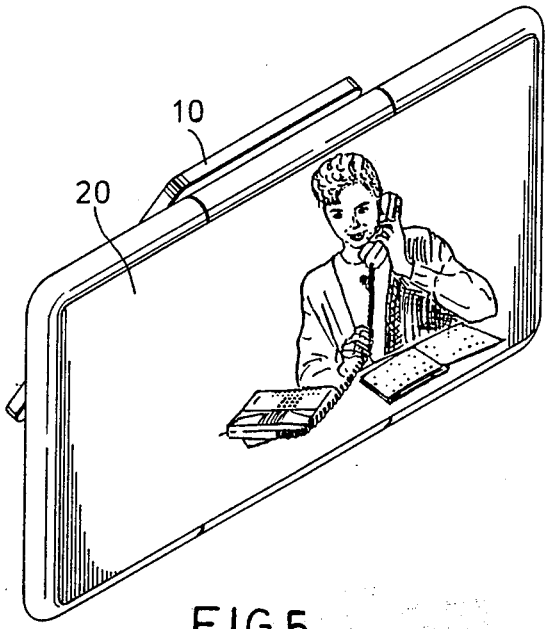

In assembly, a picture or the like is placed in the recess 221 of the base plate 22 and the cover plate 23 is slid along the surface of the base plate 22 to cause the edges of the cover plate 23 to move through the grooves 223 of the edge pieces 222, thereby also causing the edge piece 231 to clamp the edge of the base plate. Then, the edge piece 24 is attached to the base plate 22 and the cover plate 23. All the edge pieces 222, 231 and 24 are flush with each other and cooperate to form a rectangular frame. The assembly can be used as a clip unit for clamping papers or the like as well as a display board. In displaying, the assembly of the invention can be placed in a position shown in FIG. 4 or a reverse position shown in FIG. 5. Although the position of the assembly is reversed in FIG. 5, the picture can be placed in order by detaching the cover plate 23 from the base plate 22, then reversing the picture and reattaching the cover plate 23 to the base plate.

Figure 6:
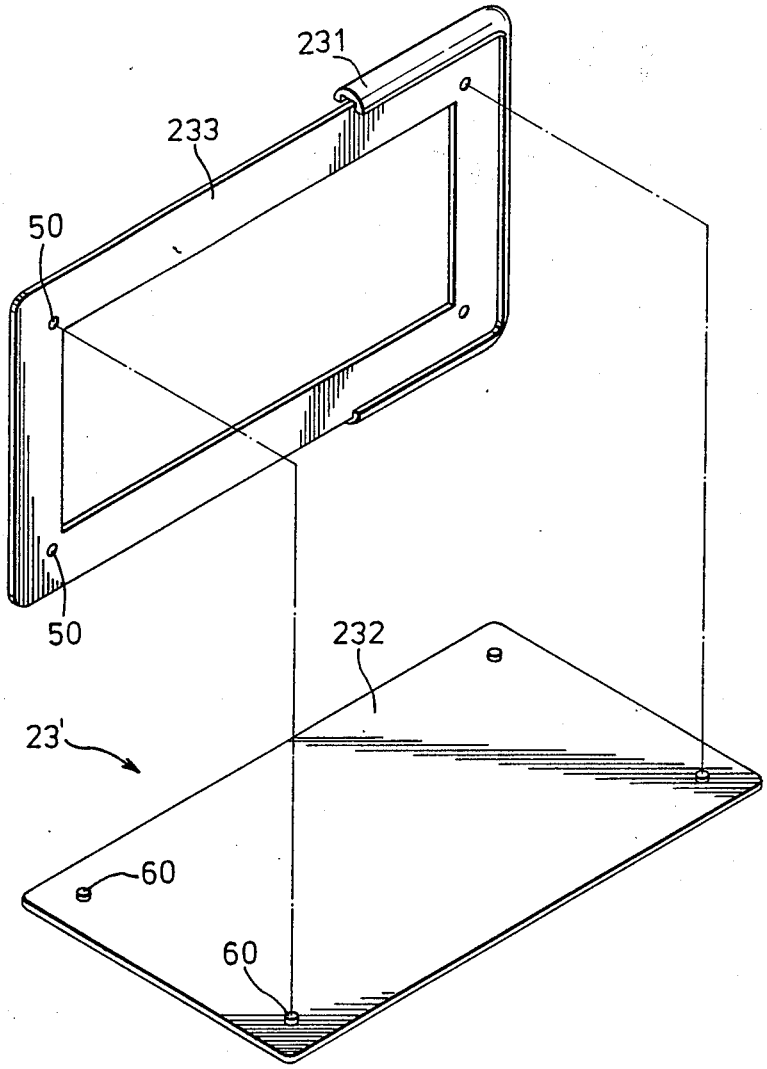
FIG. 6 shows an alternative display board for the first embodiment.

FIG. 6 shows an alternative cover plate 23' to be used instead of the cover plate 23. The plate 23' includes a plate 232 for bearing a picture and a rectangular frame 233 which are secured together by means of studs 60 and holes 50. The plate 232 is detachable so that the picture on the display board can be changed by changing the plate 232. The edge piece 231 is formed integrally with the rectangular frame 233.

Figure 7:
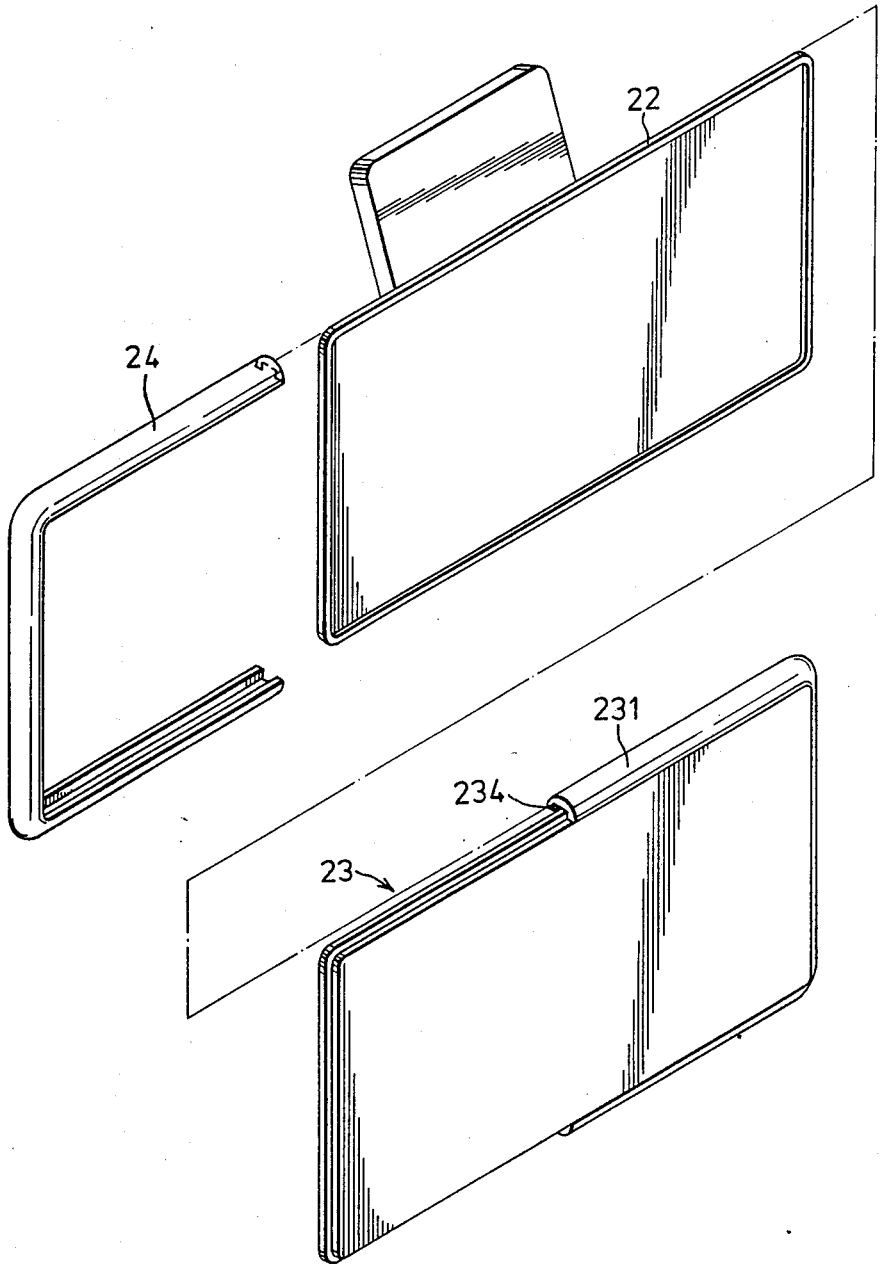
FIGS. 7 and 8 show a second embodiment of the present invention.
Figure 8:
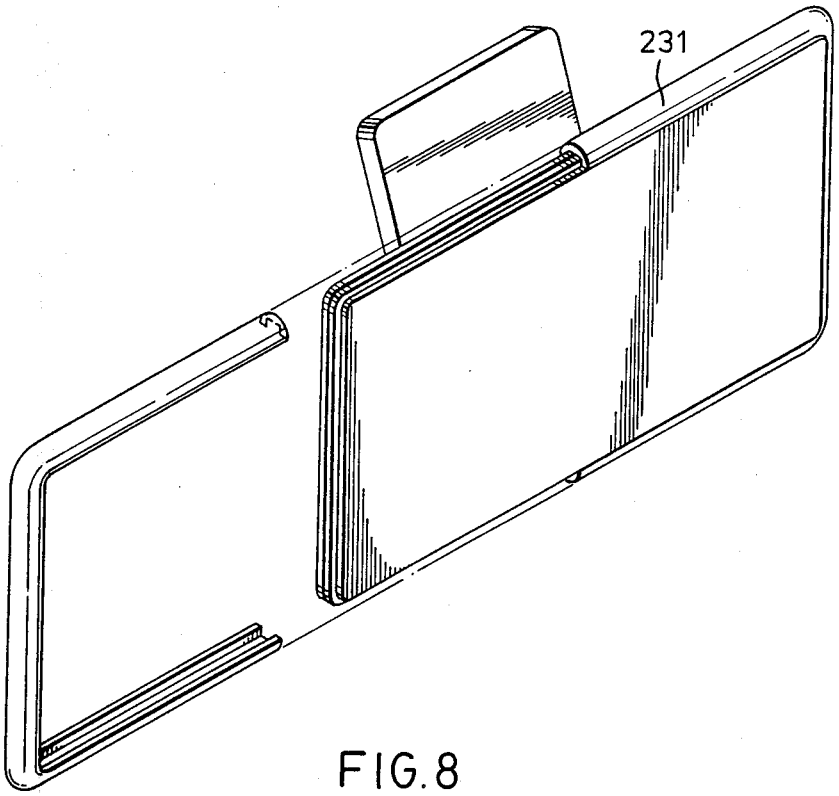

FIGS. 7 and 8 show a second embodiment of the combined display and clip board which differs from the first embodiment in such a manner that only two edge pieces 231 and 24 are provided in the second embodiment. In this embodiment, the lengths of the edge pieces 231 and 24 are increased to be in contact with one another.

Figure 9:
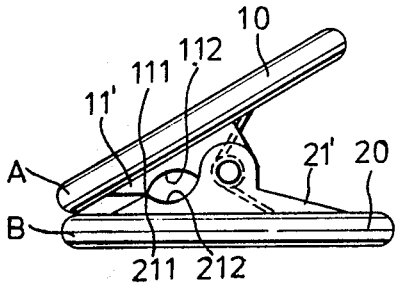
FIGS. 9, 10 and 11 show a third embodiment of the present invention.
Figure 10:
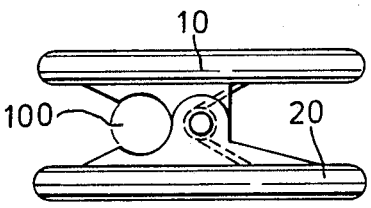
Figure 11:
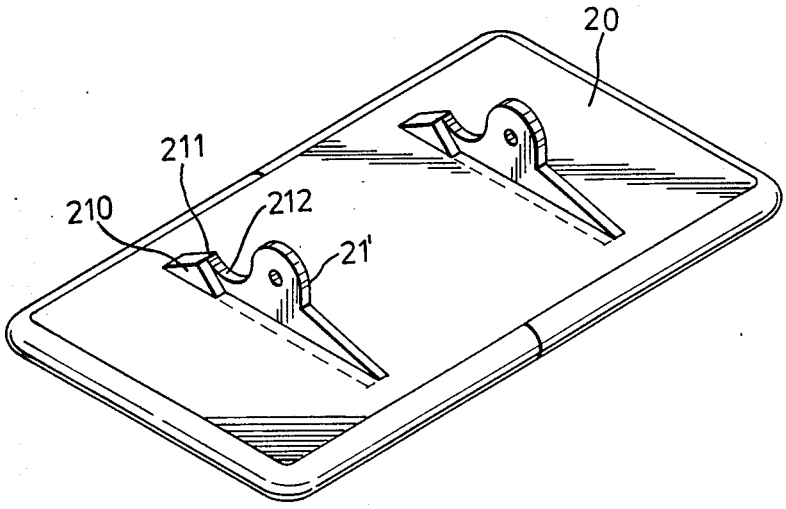

FIGS. 9, 10 and 11 show a third embodiment of the combined display and clip board which differs from the first embodiment in that the clip plate 10 is provided with a bracket plate 11' which has an engaging tip 111 and a concavity 112 and that the display board 20 is provided with a bracket plate 21' which has a projection 210 coplanar with the bracket plate 11' of the clip plate 10, an engaging tip 211 formed on the projection 210 and a concavity 212. The engaging tip 211 can engage with the tip 111 of the clip 10 to perform the clamping action. The concavities 112 and 212 can be employed for clamping a pencil 100. The the engaging tips 111 and 211 are arranged in such a manner that they causes the ends A and B of the clip plate 10 and the display board 20 to separate slightly from one another so that the edge pieces 231 and 24 can slide easily along the edges of the base plate 22.

Figure 12:
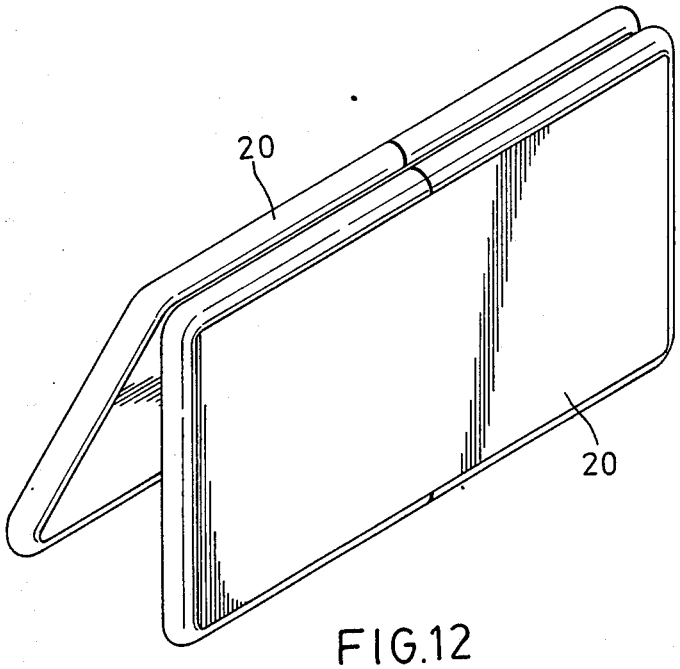
FIG. 12 shows a fourth embodiment of the present invention.

FIG. 12 shows a fourth embodiment in which the clip plate 10 of the third embodiment is replaced by a display board 20 so that two display boards 20 are connected to one another.

Figure 13:
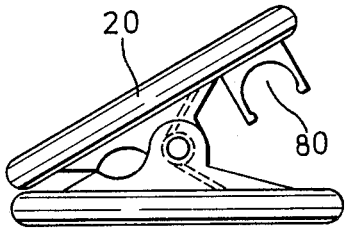
FIG. 13 shows a fifth embodiment of the present invention.

FIG. 13 shows a fifth embodiment in which the a pen holder 80 is additionally provided on the display board 20 of the third embodiment shown in FIGS. 9, 10 and 11.

Figure 14:
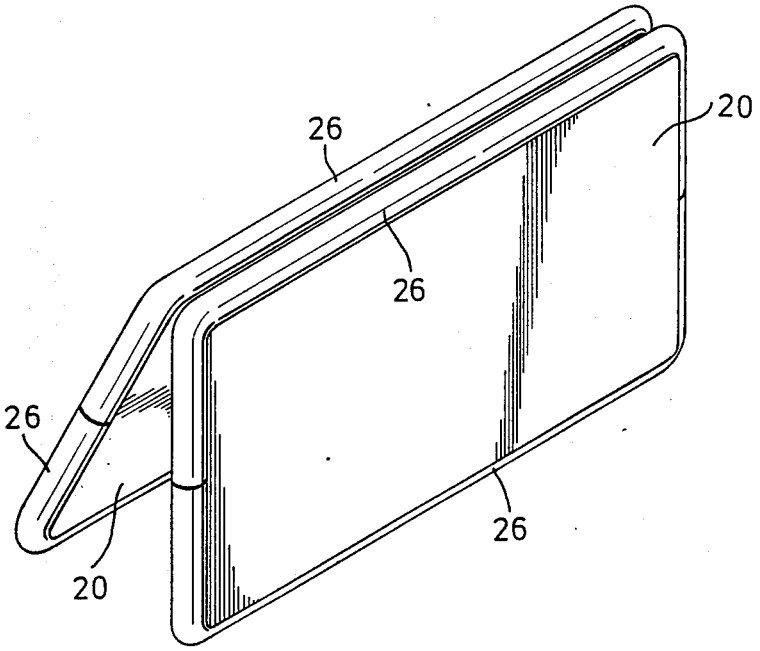
FIG. 14 shows a sixth embodiment of the present invention.

FIG. 14 shows a sixth embodiment in which the display boards 20 are provided with upper and lower edge pieces 26 instead of the edge pieces 231 and 24.

Figure 15:
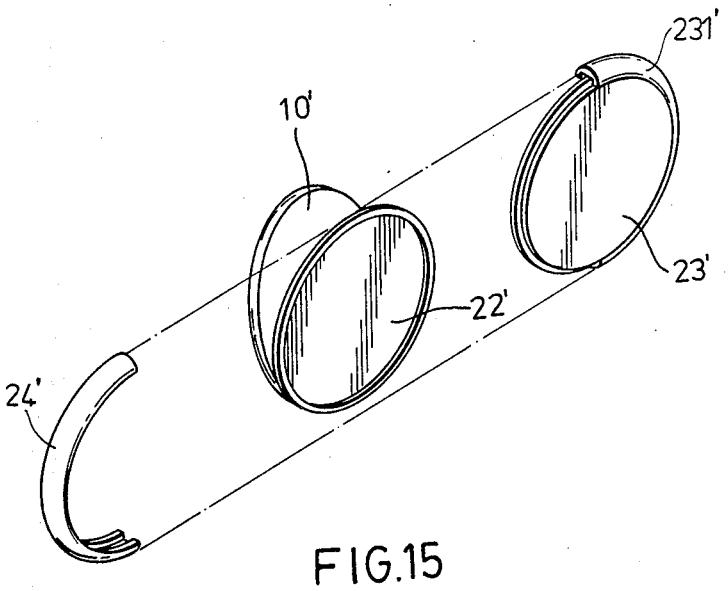
FIGS. 15 and 16 show a seventh embodiment of the present invention.
Figure 16:
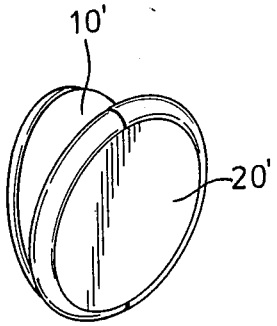

FIGS. 15 and 16 show a seventh embodiment which differs from the first embodiment in that the seventh embodiment includes a circular clip plate 10' and a circular display board 20' having a base plate 22,' a cover plate 23', an edge piece 231' integrally formed with the base plate 22' and a separate edge piece 24'.

With the invention thus explained, it is apparent that numerous modifications and variations can be made without departing from the scope of the present invention. It is therefore intended that the invention be limited only as indicated in the appended claims.

What I claim is:

1. A combined display board and clip comprising:
a first clamping member,
a second clamping member,
means for connecting said first and second clamping members in a pivotal position, and
spring means for urging said first clamping member to a clamping position with respect to said second clamping member,
wherein at least one of said first and second clamping members is a display board which includes a base plate having opposite edges, a cover plate having opposite edges, and an edge-piece means having a groove means for releaseably receiving and clamping together said edges of said cover plate and said base plate, and wherein said display board is rectangular, said edge-piece means extending along the edges of said display board and including two opposite U-shaped edge segments, one of said edge segments being formed integrally with said cover plate, the other one of said edge segments being a separate piece from said cover plate and said base plate.

2. A combined display board and clip as claimed in claim 1, wherein said cover plate is a plate bearing a display article.

3. A combined display board and clip as claimed in claim 1, wherein said cover plate is a transparent plate.

4. A combined display board and clip as claimed in claim 1, wherein said base plate is provided with a recessed face for receiving a display article.

5. A combined display board and clip as claimed in claim 1, wherein said means for connecting said first and second clamping members includes a pair of spaced apart first bracket plates extending from said first clamping member, a pair of spaced apart second bracket plates extending from said second clamping member and respectively overlapping said first bracket plates, a pivot pin threading through said first and second bracket plates, wherein each of said first and second bracket plates are elongated, said first bracket plates being provided with projections which are coplanar with said second bracket plates, said projections and said second bracket plates engaging with each other to perform a clamping operation.

6. A combined display board and clip as claimed in claim 5, wherein said first and second bracket plates are provided with curved notches for clamping a pen.

7. A combined display board and clip comprising:
a first clamping member,
a second clamping member,
means for connecting said first and second clamping members in a pivotal position, and
spring means for urging said first clamping member to a clamping position with respect to said second clamping member,
wherein at least one of said first and second clamping members is a display board which includes a base plate having opposite edges, a cover plate having opposite edges, and an edge-piece means having a groove means for releaseably receiving and clamping together said edges of said cover plate and said base plate, and wherein said display board is rectangular, said edge-piece means extending along the edges of said display board and including two opposite U-shaped edge segments and two parallel edge segments between said U-shaped edge segments, said parallel edge segments being formed integrally with said base plate, one of said U-shaped edge segments being formed integrally with said cover plate, the other one of said U-shaped edge segments being a separate piece from said cover plate and said base plate.

8. A combined display board and clip as claimed in claim 7, wherein said cover plate is a plate bearing a display article.

9. A combined display board and clip as claimed in claim 7, wherein said cover plate is a transparent plate.

10. A combined display board and clip as claimed in claim 7, wherein said base plate is provided with a recessed face for receiving a display article.

11. A combined display board and clip as claimed in claim 7, wherein said means for connecting said first and second clamping members includes a pair of spaced apart first bracket plates extending from said first clamping member, a pair of spaced apart second bracket plates extending from said second clamping member and respectively overlapping said first bracket plates, a pivot pin threading through said first and second bracket plates, wherein each of said first and second bracket plates are elongated, said first bracket plates being provided with projections which are coplanar with said second bracket plates, said projections and said second bracket plates engaging with each other to perform a clamping operation.

12. A combined display board and clip as claimed in claim 11, wherein said first and second bracket plates are provided with curved notches for clamping a pen.

13. A combined display board and clip comprising:
a first clamping member,
a second clamping member,
means for connecting said first and second clamping members in a pivotal position, and
spring means for urging said first clamping member to a clamping position with respect to said second clamping member, wherein at least one of said first and second clamping members is a display board which includes a base plate having opposite edges, a cover plate having opposite edges, and an edge-piece means having a groove means for releaseably receiving and clamping together said edges of said cover plate and said base plate, and wherein said display board is round, said edge-piece means extending along the edges of said display board and including two opposite curved edge segments, one of said curved edge segments being formed integrally with said cover plate, the other one of said curved edge segments being a separate piece from said cover plate and said base plate.

14. A combined display board and clip as claimed in claim 13, wherein said cover plate is a plate bearing a display article.

15. A combined display board and clip as claimed in claim 13, wherein said cover plate is a transparent plate.

16. A combined display board and clip as claimed in claim 13, wherein said base plate is provided with a recessed face for receiving a display article.

17. A combined display board and clip as claimed in claim 13, wherein said means for connecting said first and second clamping members includes a pair of spaced apart first bracket plates extending from said first clamping member, a pair of spaced apart second bracket plates extending from said second clamping member and respectively overlapping said first bracket plates, a pivot pin threading through said first and second bracket plates, wherein each of said first and second bracket plates are elongated, said first bracket plates being provided with projections which are coplanar with said second bracket plates, said projections and said second bracket plates engaging with each other to perform a clamping operation.

18. A combined display board and clip as claimed in claim 17, wherein said first and second bracket plates are provided with curved notches for clamping a pen.

* * * * *